US005234078A

United States Patent [19]

Smith

[11] Patent Number: 5,234,078

[45] Date of Patent: Aug. 10, 1993

[54] COLLAPSING STAIR LIFT

[75] Inventor: Virgil A. Smith, Stony Mountain, Canada

[73] Assignee: Daniel K. Roth, Winnipeg, Canada

[21] Appl. No.: 905,457

[22] Filed: Jun. 29, 1992

[51] Int. Cl.[5] ..... B66B 9/20

[52] U.S. Cl. ..... 187/9 R; 414/921; 280/166

[58] Field of Search ..... 187/9 R, 1 R, 12; 414/921, 545; 280/166; 105/449, 447

[56] References Cited

U.S. PATENT DOCUMENTS

| | | | |
|---|---|---|---|
| 2,740,165 | 4/1956 | Ward | 52/183 |
| 3,957,284 | 5/1976 | Wright | 280/166 |
| 4,251,179 | 2/1981 | Thorley | 414/545 |
| 4,285,416 | 8/1981 | Dudynskyj | 187/9 R |
| 4,299,528 | 11/1981 | Kazeil et al. | 414/546 |
| 4,457,402 | 7/1984 | Del Vecchio et al. | 414/921 |
| 4,583,466 | 4/1986 | Reddy et al. | 414/921 |
| 4,606,433 | 8/1986 | Smalley et al. | 414/921 |
| 4,804,308 | 2/1989 | Hamblin et al. | 414/921 |

*Primary Examiner*—Robert P. Olszewski
*Assistant Examiner*—Kenneth Noland
*Attorney, Agent, or Firm*—Murray E. Thrift; Stanley G. Ade; Adrian D. Battison

[57] ABSTRACT

A collapsible stair lift is operable between an upper floor level and a lower floor level. The lift has a set of collapsing steps that lower from their normal in use condition to a position in which the treads of the various steps are flush with the lower floor. A platform is located at the top of the stairs and lowers from the top of the stairs to a position flush with the stair treads. The unit is particularly useful in domestic environments where space is limited.

22 Claims, 6 Drawing Sheets

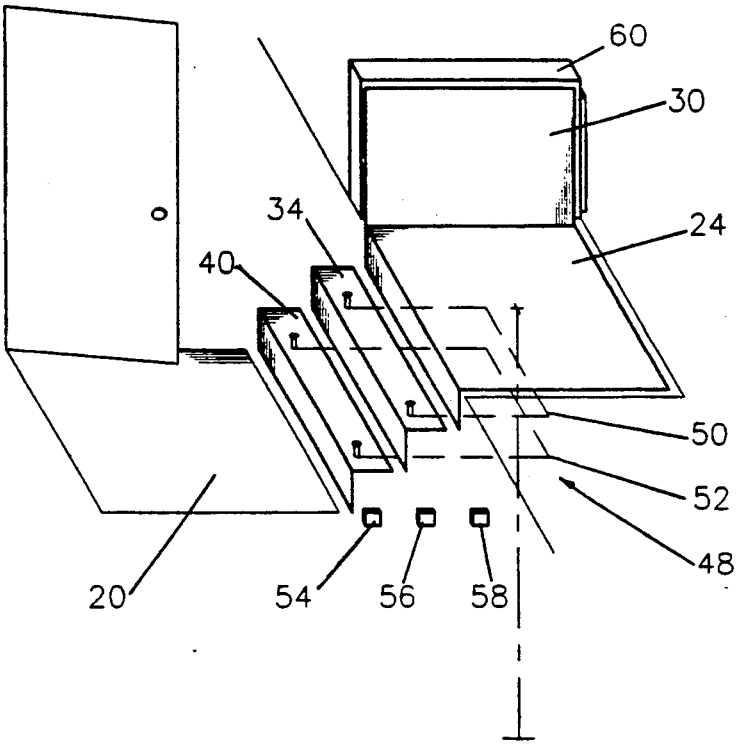
FIG. 3A
FIG. 3B
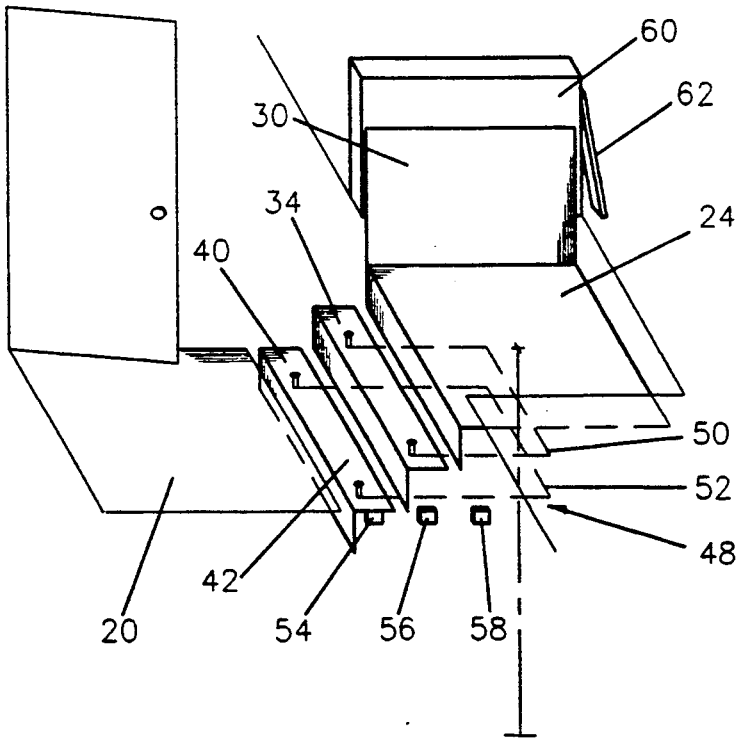

COLLAPSING STAIR LIFT

FIELD OF THE INVENTION

The present invention relates to elevating devices more particularly to a combined stair and lift particularly suited for domestic use.

BACKGROUND

Persons constrained to use wheel chairs find access to many houses barred by stairs leading from an entrance level to the main floor level, typically two or three steps higher. A typical entrance of the type in question has a relatively narrow, small vestibule between the entrance door and the stairs. The inherent space limitations of such an arrangement prevent the use of known lifts, for example that disclosed in Del Vecchio et al, U.S. Pat. No. 4,457,402.

In the Del Vecchio et al device, the lifting platform is located at the bottom of a set of collapsing stairs so that the entire unit can be placed on the vertical face of a raised structure. A device of this sort used in the environment in question would require location of the lifting platform in the vestibule at the bottom of the stairs. The platform may require safety railings, which would interfere with access to the platform and could interfere with opening of a door into the vestibule. The use of stairs which rise to a level with the upper floor requires the use of side panels on each side of the stairs and a movable hand rail arrangement. All of these problems make such a device unsuitable for the present purposes.

The intent of the present invention is to provide a combined stair and lift suitable for use in the restricted space normally encountered in a house.

SUMMARY

According to one aspect of the present invention there is provided a stair lift operable between an upper floor level and a lower floor level, the lift comprising:

stair means having an upper end and a lower end and comprising at least one step member having a tread;

a platform positioned at the upper end of the stair means; and lift means for moving the platform and stair means between a raised position with the platform flush with the upper floor level and the stair means forming a stairway from the platform to the lower level, and a lowered position with the platform and the tread of each step member flush with the lower floor level.

With the platform at the top of the stairs, it can be set into a well in the upper floor, eliminating interference with the limited space at the lower landing or vestibule level. Existing walls, hand rails and stair stringers may remain in place in an retrofit installation, which is expected to be the normal case. Where necessary, barriers can be provided around the well on the fixed upper floor, although in many cases this will be unnecessary since existing walls will serve this purpose.

It is preferred that the lifting means for raising and lowering the platform and steps is a frame mounted under the platform and steps, in the well into which they are set. With the steps, it is preferred that they are raised from the lowered position using a frame that engages the steps with a retaining mechanism, preferably a pin and socket system for preventing movement of the steps on the frame. This eliminates any guide tracks at the opposite ends of the steps. Guide tracks of this sort are aesthetically undesirable and also provide gaps into which foreign objects, including fingers and the like can be lodged. In addition, it is preferred that the platform and steps have a fail safe lowered position in which all of the steps and the platform are supported on fixed supports and not by the lifting frame.

According to another aspect of the present invention there is provided a combined stair and lift having a platform movable between a raised position and a lowered position, collapsible stair means at one side of the platform, hydraulic jack means for raising and lowering the platform and stair means, pump means for pumping fluid into the jack means for raising the platform and stair means, fluid release means for selectively releasing fluid from the jack means to allow the platform and stair means to move from the raised position to the lowered position under gravity, and flow restrictor means for restricting the flow of fluid from the jack means thereby to control lowering of the platform and stair means.

The hydraulic lift, with its outlet flow restrictor, requires power only for raising the platform stairs. When the platform is lowered, fluid is exhausted from the lifting jack through the flow restrictor, thus providing an entirely passive lowering of the platform and stairs. Thus, in the event of a power interruption, the lift may be still be used to move safely to the lower floor, where the exit door is located.

BRIEF DESCRIPTION OF THE DRAWINGS

In the accompanying drawings, which illustrate an exemplary embodiment of the present invention:

FIG. 3A through 3D are somewhat schematic drawings showing the stages in lowering the platform and steps from the raised position to the lowered position;

DETAILED DESCRIPTION

Figure 1:
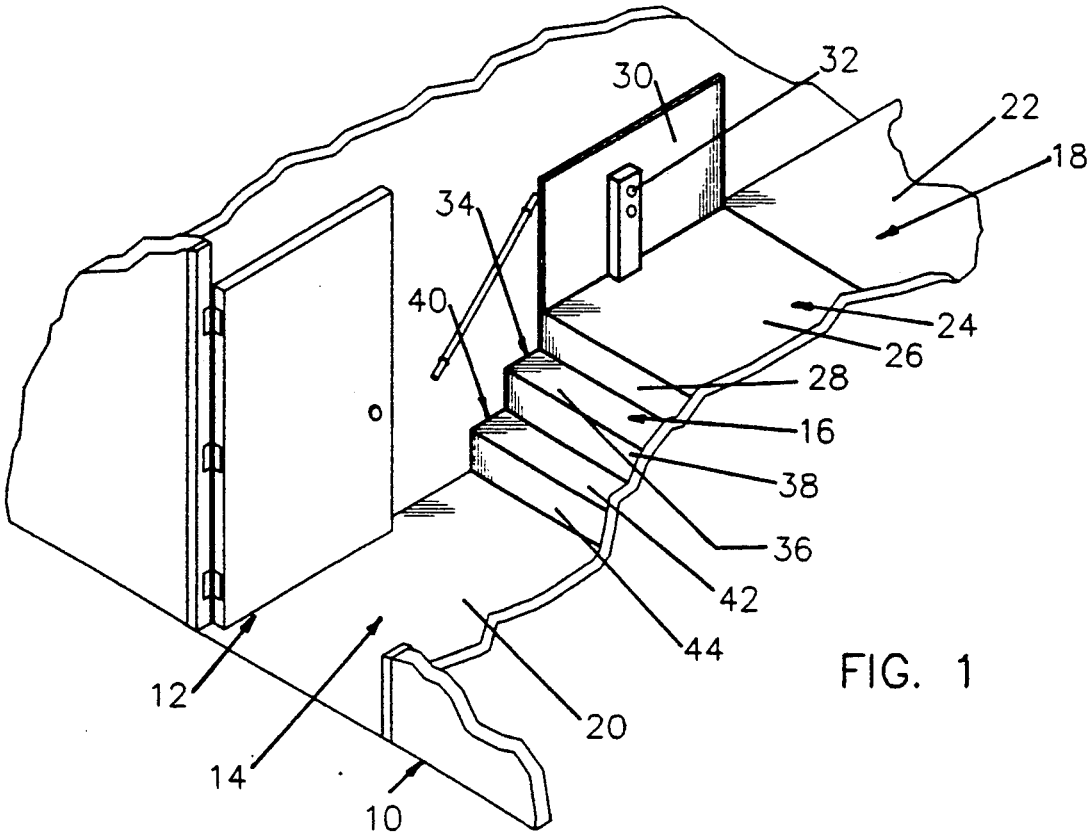
FIG. 1 is an isometric representation of the lift and stair installed and in a raised position.
Figure 2:
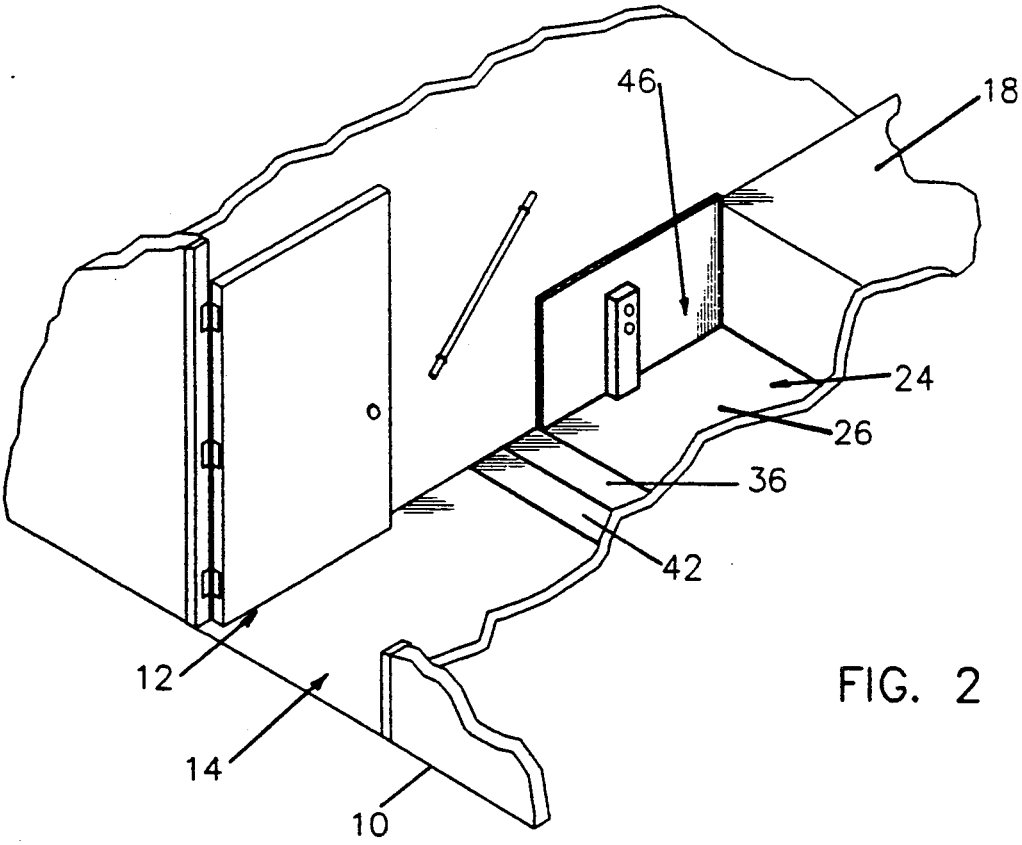
FIG. 2 is a view like FIG. 1 with the lift and stairs in a lowered condition.

Referring to the accompanying drawings, especially to FIGS. 1 and 2, there is illustrated a building 10 having an entrance door 12 opening into a vestibule 14. The vestibule ends at a stairway 16 leading to an entrance hall 18. Thus, the stairway 16 extends between the vestibule lower floor 20 and the hall floor 22. To provide a lift mechanism between these two floors, the upper floor adjacent the top of the stairs is formed as a platform 24 with a floor 26 and a riser 28 along that side adjacent the stairs. The platform has two upright side walls 30 along opposite sides of the hall and a control column 32 containing controls for the lift.

The stairway includes an upper step 34 with a tread 36 and a riser 38, and a lower step 40 with a tread 42 and a riser 44. The platform and the two steps may be lowered into a well 46 that extends into both the lower and upper floors as will be discussed more fully in the following.

Figure 3C:
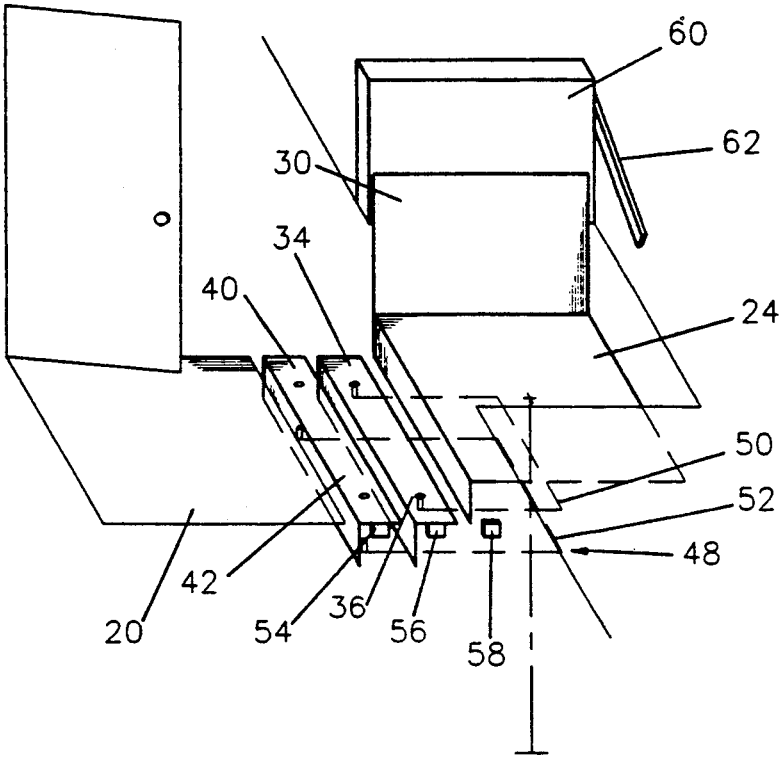
Figure 3D:
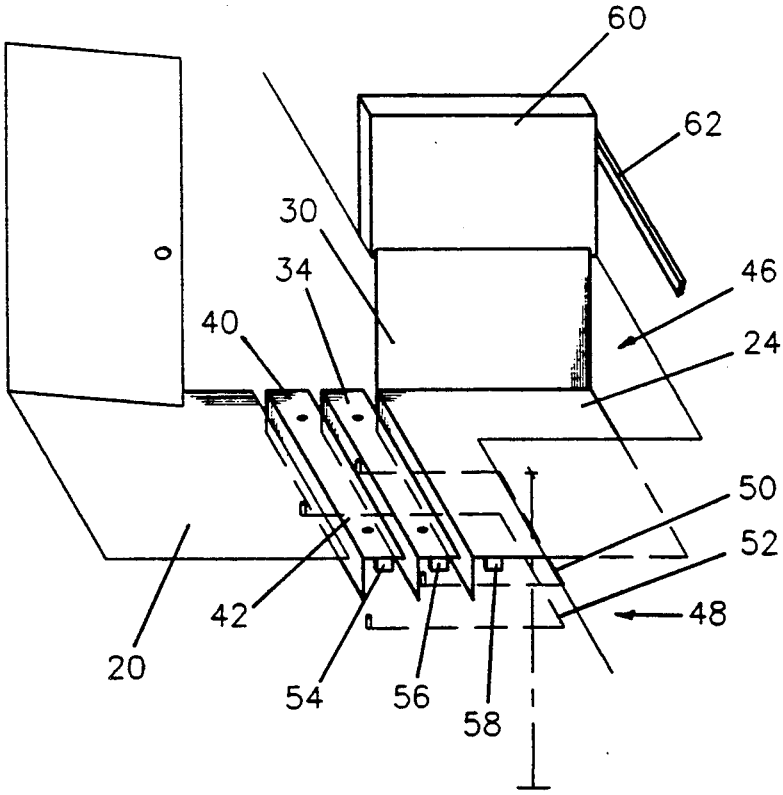
Figure 4:
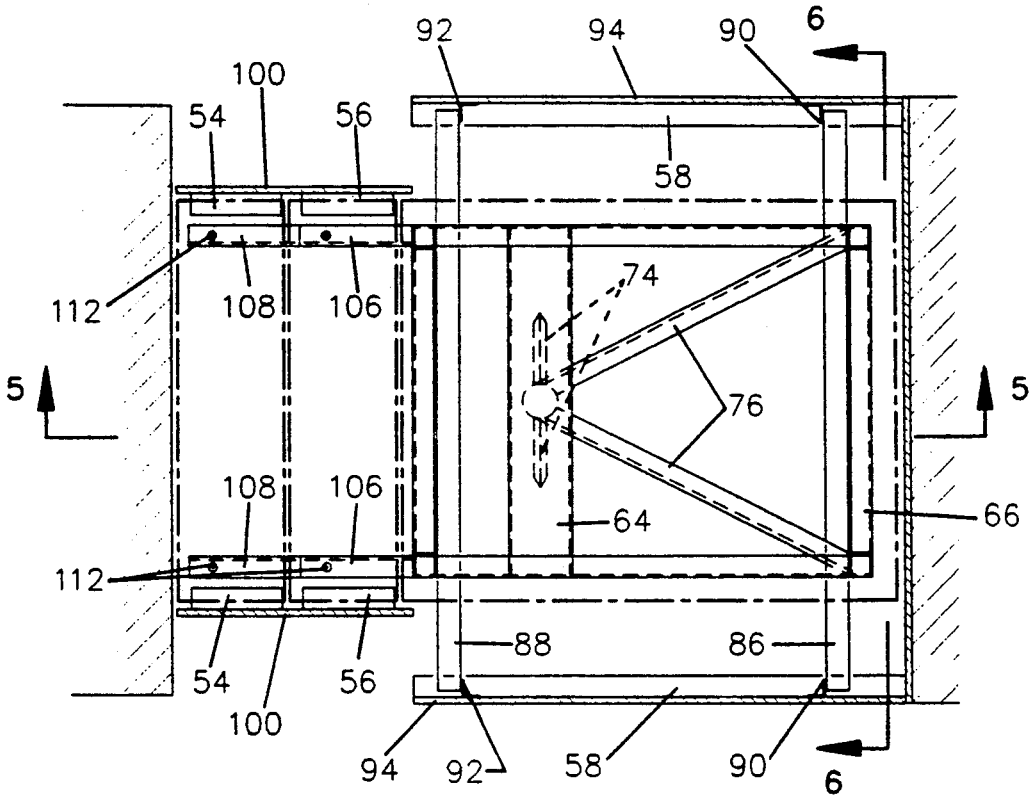
FIG. 4 is a plan view with the platform and steps shown in broken line.
Figure 5:
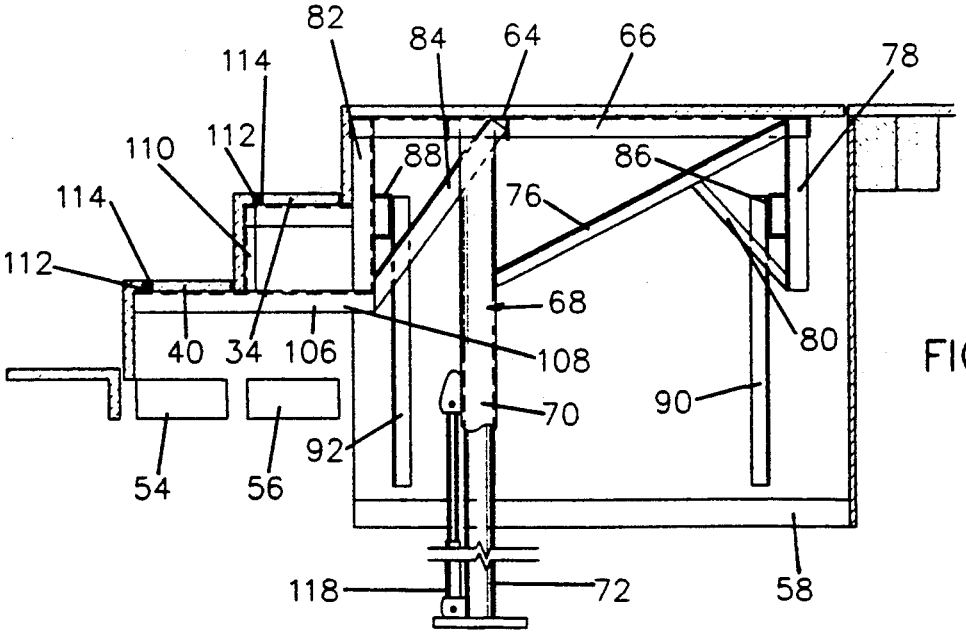
FIG. 5 is a view along line 5—5 of FIG. 4.
Figure 6:
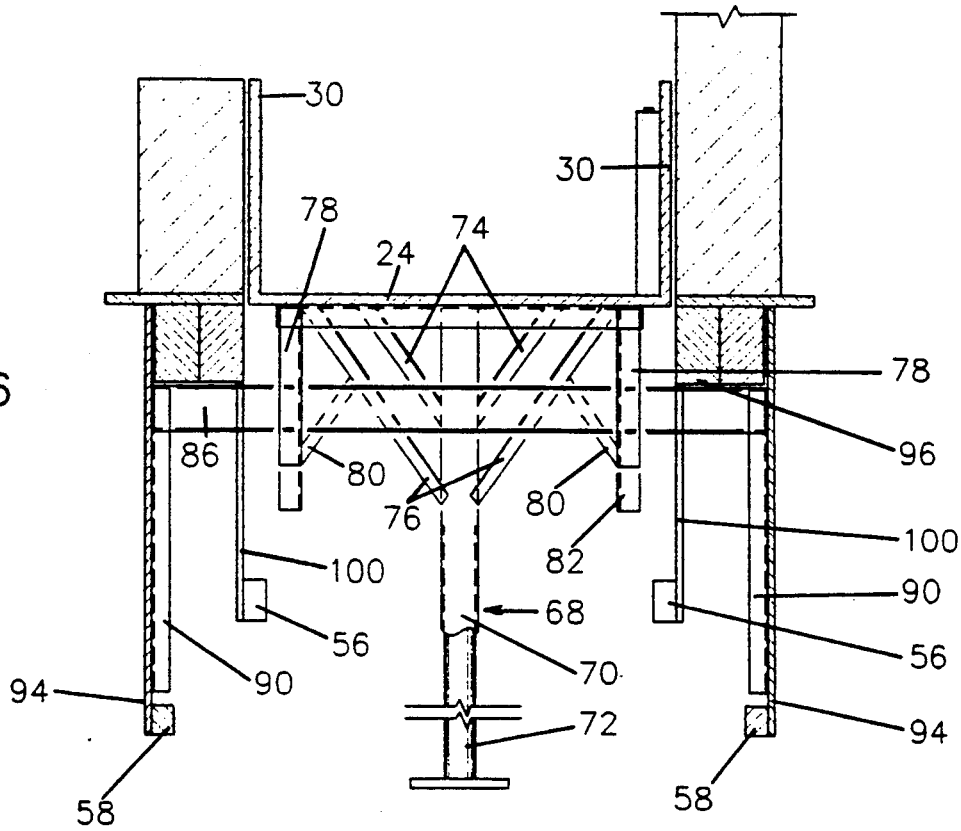
FIG. 6 is a view along line 6—6 of FIG. 4.

As schematically illustrated in FIGS. 3A to 3B, the platform and stairs are supported on a frame 48 located in the well 46. The frame supports the platform 24 directly and has a frame arm 50 projecting to the front of the platform to support the step 34. A second frame arm 52 projects beyond the frame arm 50 and is located somewhat below it to support the step 40. The frame 48 and frame arms 50 and 52 support the platform and steps in the raised condition as illustrated most particularly in FIG. 3A. As the frame 48 and the frame arms 50 and 52 are lowered, the platform and the steps are also lowered until the step 40 comes into engagement with step supports 54, which support the step with its tread 42 flush with the lower floor 20 of the vestibule as illustrated in FIG. 3B. As the frame and frame arms are lowered further, the step 34 comes into engagement with step supports 56, which support that step with its tread 36 flush with the floor 20. Further lowering of the frame brings the platform down to a position where it is supported by platform supports 58, with the platform flush with the lower floor, as illustrated in FIG. 3D.

FIGS. 3A through 3D also illustrate a barrier 60 that is positioned along one side of the well 46. In this embodiment, the barrier is a false wall. In the installation illustrated in FIGS. 1 and 2, fixed walls of the hallway serve as barriers to prevent stepping off the upper floor into the well when the platform is lowered.

The barrier in this embodiment is also equipped with a gate 62 that is raised across the back side of the well 46 as the platform is lowered, for safety purposes.

The construction of the frame 50 is most clearly illustrated in FIGS. 4 through 7. The frame includes a main cross member 64 in the form of a channel supporting a rectangular platform frame 66 on the top of a telescopic column 68. The column includes an outer tube 70 secured to the center of the channel 64 and an inner tube 72 supported on a basement floor by a base plate 73.

Two side braces 74 extend outwardly from the tube 70 to the cross member 64 to support the cross member laterally on the column. Two rear braces 76 slope outwardly and upwardly to the rear from the outer tube 70 to the corners of the platform frame 66. At the back end of the platform frame are two vertical legs 78 that are supported in place by braces 80 extending from the lower ends of the legs to the rear braces 76. At the front of the platform frame are two front legs 82 that are braced against the sides of the platform frame by braces 84.

A horizontal control arm 86 is mounted on the back legs 78 and projects to opposite sides of the frame. A similar control arm 88 is mounted on the two front legs 82. The two control arms 86 and 88 slideably engage respective ones of two vertical control arm guides 90 and 92 mounted on the side walls 94 of the well 46. The guides are located between the control arms to guide the platform for vertical movement and without rotation.

The side walls 94 of the well are mounted on the upper floor joists 96 on opposite sides of the well. The platform supports 58 are horizontal beams mounted on the side walls 94 to engage the ends of the control arms and support the platform in its lowered position.

At opposite ends of the steps, the well sides are provided by two side walls 100 which carry two blocks each as the step supports 54 and 56.

The two frame arms 50 and 52 are parts of a step frame 104 that is mounted on the front legs 82 of the platform frame. The frame arm 50 includes two support arms 106 projecting forwardly from the respective legs 82 while the frame arm 52 consists of two similar support arms 108 projecting forwardly, also from the legs 82. The support arms 108 are connected to the support arms 106 by vertical legs 110.

Each of the support arms 106 and 108 includes a vertical pin 112 that seats in a matching bore 114 in the associated one of steps 34 and 40. The pins and bores act as alignment mechanisms which prevent the steps from moving on the frame arms when in the raised position.

Figure 7:
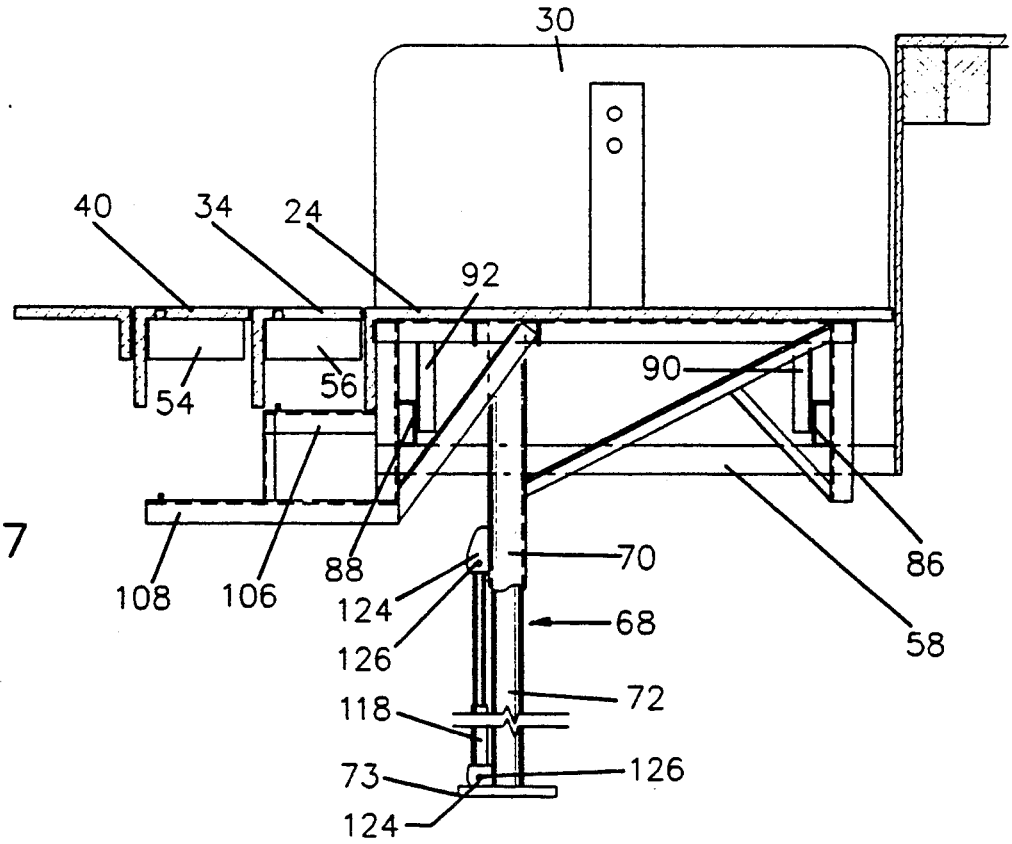
FIG. 7 is a view like FIG. 6 with the platform shown in a lowered position.

As illustrated most particularly in FIG. 7, when the platform is in its lowered position, the platform side walls 30 cover the sides of the well between the upper floor and the platform level. Thus, the control arm guides 90 and 92 are not exposed and there is not gap into which objects, fingers or toes can be placed to be caught when the platform is raised.

The lifting mechanism for the platform includes the telescopic column 68 and an hydraulic cylinder 118 connected to the column base plate by two lugs 120 and a pin 112 and connected by its rod end to the outer cylinder by two lugs 124 and a pin 126. Extension of the cylinder will raise the platform and will sequentially pick up the steps 34 and 40 and raise them all to their raised locations.

Figure 8:
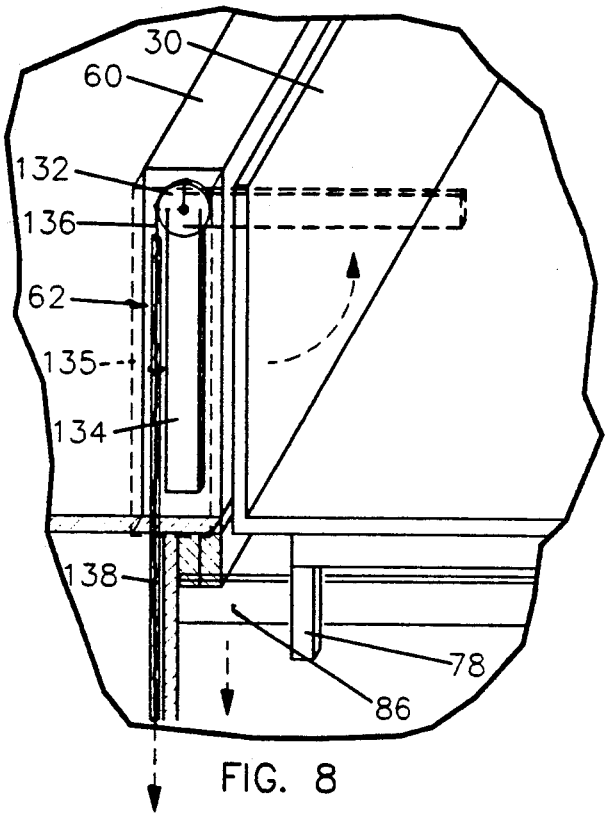
FIG. 8 and 9 illustrate an automatic gate.
Figure 9:
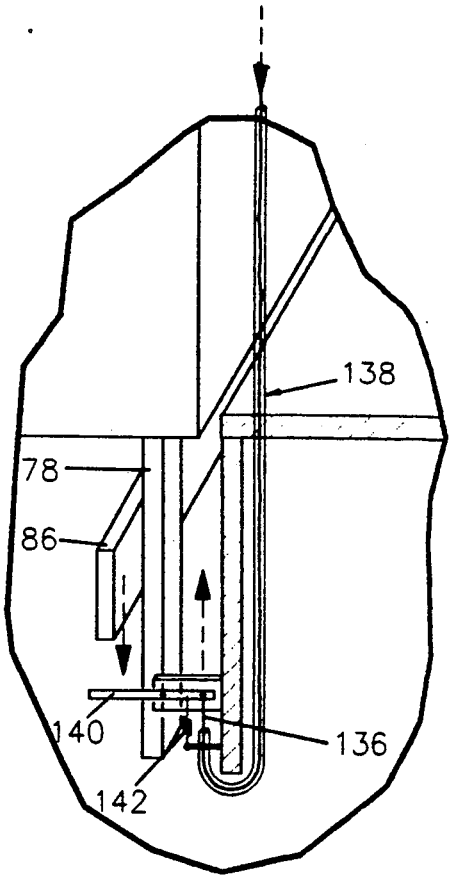

A gate mechanism for enclosing the open side of the well 46 when the platform is lowered is illustrated most particularly in FIGS. 8 and 9. The illustrated gate 62 includes a rotor 132 with a barrier arm 134. The rotor is pivotally mounted on the end of the barrier 60 and is covered with an enclosure 135 with a slot on the inner side. A cable 136 is connected to the rotor and extends from the rotor through a cable guide 138 which extends down the back of the back wall of the well 46 and around the bottom edge of that wall. The cable end is connected to an arm 140 pivotally mounted on the back wall and biased to the horizontal position illustrated in FIG. 9 by a spring 142. The end of the arm 140 opposite the cable connection projects into the path of the control arm 86 so that as the control arm descends with the platform, it will pivot the arm 140 and pull on the cable 136 to rotate the rotor 132 and bring the arm to a horizontal position projecting across the open back side of the well.

Figure 10:
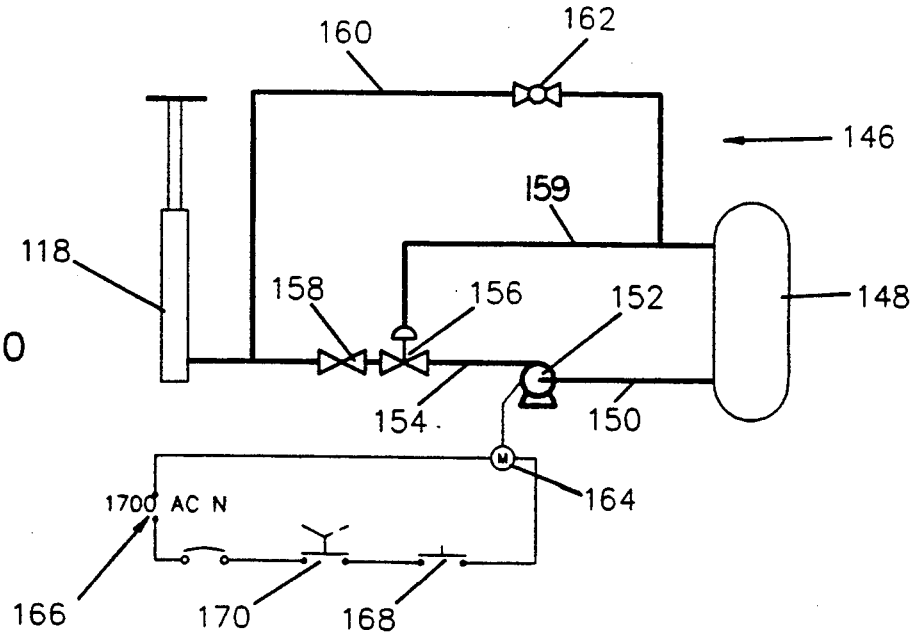
FIG. 10 is a schematic of the electrical and hydraulic operating circuits.

FIG. 10 illustrates the control circuit for the lift. The circuit includes an hydraulic circuit 146 including an hydraulic fluid reservoir 148 connected by a supply line 150 to a pump 152. The pump supplies fluid through a line 154 to the hydraulic cylinder 118 through a pressure relief valve 156 and a check valve 158. The relief valve is adjustable and opens to return fluid to the reservoir through a relief line 159.

A fluid return line 160 leads from the line 154 between the check valve 158 and the hydraulic cylinder to the return line 159. This line contains a control valve 162 that includes a flow restriction.

The pump 152 is driven by an electric motor 164 connected to a power supply 166 in series with an on-off switch 168 and a push button normally open switch 170.

In use, in order to raise the platform from the lowered position, the push button switch 170 is pressed and, as along as the button is pressed, the motor 164 will drive the pump 152 to deliver pressurized hydraulic fluid to the hydraulic cylinder 118. This raises the frame 48 and the frame arms 50 and 52 to raise the platform and the steps.

When the push button switch is released, the motor is stopped and the lift is retained in its raised position by the check valve 158 and the closed control valve 162. When it is desired to lower the platform, the control valve 162 is open and the weight of the platform, steps and frame force the hydraulic fluid from the cylinder back to the reservoir through the return line 160. Because of the flow restriction in the control valve 162 this descent is relatively slow.

As will be understood from the foregoing, the collapsing stair lift of the present invention is readily installed in place of an existing flight of stairs, even when there is limited space available at the bottom of the flight. Most existing auxiliary structure, such as hand rails for the stairwell do not need replacement. The controls for the unit are shown mounted on a control column in FIGS. 1 and 2. Other arrangements could be provided if desired.

It is to be understood that the present invention is not limited to the embodiments described in the foregoing specification. Other embodiments are possible and are intended to be included within the scope of the invention. The invention is to be construed as limited solely by the scope of the appended claims.

I claim:

1. In a building having a lower floor and an upper floor, a combined stair and lift between the lower and upper floors, said stair and lift comprising:

a well extending into the upper and lower floors;

a platform extending across the well where it extends into the upper floor and having a surface area sufficient to support a wheelchair;

stair means extending across the well where it extends into the lower floor, the stair means having an upper end adjacent the platform and a lower end adjacent the lower floor and comprising at least one step member having a tread, the or each tread having a surface area substantially smaller than that of the platform; and lift means in the well for moving the platform and stair means between a raised position with the platform flush with the upper floor and the stair means forming a stairway from the lower floor to the platform, and a lowered position with the platform and each step tread flush with the lower floor.

2. A stair lift according to claim 1 wherein the stair means comprise a plurality of step members.

3. A stair lift according to claim 1 including fixed step support means for supporting each step member in the lowered position thereof.

4. A stair lift according to claim 3 including fixed platform support means for supporting the platform in the lowered position thereof.

5. A stair lift according to claim 4 wherein the lift means comprise a rigid frame means engaging the underside of the platform and movable therewith between the raised and lowered positions of the platform, the frame means including step frame means for engaging each step member and supporting each step member when above the lowered position thereof, and means for lowering the frame means.

6. A stair lift according to claim 5 wherein the step frame means include step retainer means for engaging each step member to prevent substantial movement of the step member with respect to the step frame means.

7. A stair lift according to claim 6 wherein the step retainer means comprise inter-engaging pins and apertures on the frame means and the step member.

8. A stair lift according to claim 7 including guide means mounted on the frame means for maintaining substantial horizontal alignment of the frame means.

9. A stair lift according to claim 1 wherein the lift means comprise an hydraulic cylinder, means for selectively pumping hydraulic fluid into the cylinder to move the platform and stair means to their raised positions, and flow restrictor means for restricting the flow of hydraulic fluid from the cylinder.

10. A stair lift according to claim 1 wherein the platform means comprise two upright side walls.

11. The invention according to claim 1 wherein the lift means comprise frame means below the platform and the stair means and means for raising and lowering the frame means.

12. The invention according to claim 11 wherein the well comprises side walls and including step support means secured to the side walls for engaging and supporting the steps in their lowered positions.

13. The invention according to claim 12 including platform support means secured to the side walls and the well for supporting the platform in its lowered position.

14. The invention according to claim 11 including cooperating guide means mounted on the side walls and the frame means for guiding the movement of the platform between its raised and lowered positions.

15. The invention according to claim 1 wherein the platform comprises two side walls extending along respective sides of the well.

16. The invention according to claim 1 including barrier means on the upper floor, along respective sides of the well.

17. In a building having a lower floor and an upper floor, a combined stair and lift between the lower and upper floors, said stair and lift comprising:

a well extending into the upper and lower floors;

a platform extending across the well where it extends into the upper floor;

stair means extending across the well where it extends into the lower floor, the stair means having an upper end adjacent the platform and a lower end adjacent the lower floor and comprising at least one step member having a tread;

lift means in the well for moving the platform and stair means between a raised position with the platform flush with the upper floor and the stair means forming a stairway from the lower floor to the platform, and a lowered position with the platform and each step tread flush with the lower floor;

barrier means on the upper floor, along respective sides of the well; and gate means mounted on the barrier means for closing a third side of the well.

18. The invention according to claim 17 including means for closing the gate means in response to movement of the platform from the raised position to the lowered position.

19. A stair lift operable between an upper floor level and a lower floor level, the lift comprising:

stair means having an upper end and a lower end and comprising at least one step member having a tread;

a platform positioned at the upper end of the stair means;

lift means for moving the platform and stair means between a raised position with the platform flush with the upper floor level and the stair means forming a stairway from the platform to the lower level, and a lowered position with the platform and the tread of each step member flush with the lower floor level, the lift means comprising a rigid frame means engaging the underside of the platform and movable therewith between the raised and lowered positions of the platform, the frame means including step frame means for engaging each step member and supporting each step member when above the lowered position thereof, and means for lowering the frame means;

fixed step support means for supporting each step member in the lowered position thereof; and fixed platform support means for supporting the platform in the lowered position thereof.

20. A stair lift according to claim 19 wherein the step frame means include step retainer means for engaging each step member to prevent substantial movement of the step member with respect to the step frame means.

21. A stair lift according to claim 20 wherein the step retainer means comprise inter-engaging pins and apertures on the frame means and the step member.

22. A stair lift according to claim 21 including guide means mounted on the frame means for maintaining substantial horizontal alignment of the frame means.

* * * * *